US006385866B1

(12) United States Patent
Sotter

(10) Patent No.: US 6,385,866 B1
(45) Date of Patent: May 14, 2002

(54) FOOT WEAR TREAD APPARATUS AND METHOD OF USE

(76) Inventor: J. George Sotter, 26705 Loma Verde, Mission Viejo, CA (US) 92691-6055

( * ) Notice: Subject to any disclaimer, the term of this patent is extended or adjusted under 35 U.S.C. 154(b) by 0 days.

(21) Appl. No.: 09/738,065

(22) Filed: Dec. 18, 2000

(51) Int. Cl.[7] ..... A43B 23/28; A43C 15/00

(52) U.S. Cl. ..... 36/67 R; 36/59 R; 36/59 C; D02/951; D02/956; D02/960

(58) Field of Search ..... 36/67 R, 59 R, 36/59 C, 59 A, 59 B; D02/951, 952, 953, 956, 960

(56) References Cited

U.S. PATENT DOCUMENTS

| | | | | | |
|---|---|---|---|---|---|
| 736,082 | A | | 8/1903 | Foreman et al. | |
| 1,049,087 | A | | 12/1912 | Hill | |
| D55,528 | S | | 6/1920 | Piper | |
| 2,049,598 | A | * | 8/1936 | Tubbs | 36/67 R |
| 2,433,303 | A | * | 12/1947 | Spini | 36/59 C |
| D252,420 | S | | 7/1979 | Bowers et al. | |
| 4,173,083 | A | | 11/1979 | Infusino | |
| D255,173 | S | | 6/1980 | Finn | |
| D336,560 | S | | 6/1993 | Peterson | |
| D336,978 | S | * | 7/1993 | Peterson | D2/953 |
| D336,979 | S | | 7/1993 | Peterson | |
| D341,024 | S | | 11/1993 | Peterson | |
| D352,155 | S | | 11/1994 | Merceron | |
| D357,347 | S | * | 4/1995 | Leick | D2/951 |
| D374,337 | S | | 10/1996 | Murai et al. | |
| D408,976 | S | * | 5/1999 | Shanks et al. | D2/953 |
| D409,360 | S | | 5/1999 | Movitz | |
| D420,208 | S | * | 2/2000 | Birkenstock | D2/952 |
| D420,496 | S | | 2/2000 | Singer | |
| 6,055,746 | A | * | 5/2000 | Lyden et al. | 36/59 C |
| D427,754 | S | | 7/2000 | Portaud | |
| D431,346 | S | * | 10/2000 | Birkenstock | D2/953 |
| D436,247 | S | * | 1/2001 | Burt | D2/951 |
| D442,357 | S | * | 5/2001 | Burt | D2/951 |
| D443,975 | S | * | 6/2001 | Della Valle | D2/951 |

* cited by examiner

*Primary Examiner*—Anthony Stashick
(74) *Attorney, Agent, or Firm*—William W. Haefliger

(57) ABSTRACT

The method of providing cleats on a boot sole to provide traction in all directions, that includes the steps providing the cleats to have profiles with short and long axes, locating the cleats to extend on the sole in criss-cross diagonal row configuration, the cleats oriented to have their long axes extending at positive and negative angles relative to the direction of the sole.

15 Claims, 3 Drawing Sheets

17
18
18a
12
11b
11
31
α
11a
10a
12b
13
β
12a
12
10b
10
30
32
2
3
3
2
10c
15a
15
16
15

18
10a
12
11
35
10
7
12
7
10b
10c
15

FOOT WEAR TREAD APPARATUS AND METHOD OF USE

BACKGROUND OF THE INVENTION

This invention relates generally to cleats applied to the soles of foot wear; and more particularly to improvements in cleats applied to shoe or boot soles to maximize traction.

There is continual need, as in workplaces, for foot wear providing a high degree of traction, preventing slippage. This need is particularly important where floor, ground or work surfaces contacted by the foot wear are slippery, for safety purposes. The prevention of slips, trips, and loss of balance by those who work at heights is important to eliminate falls that can lead to serious injury, or death. Reliable foot wear traction increases confidence of workers, enhancing working efficiency.

SUMMARY OF THE INVENTION

It is a major object of the invention to provide improvements in cleats as applied to foot wear, and in cleat configurations on soles of boots or boots, to meet the above needs. Basically, cleats are configured to provide traction in all directions, such as parallel to the foot wear sole, and the invention includes:

a) cleats provided to have generally elliptical profiles, with short and long axes, b) the cleats located to extend on the sole in criss-cross diagonal configurations. Certain cleats may be located in rows, and oriented to have their long axes extending generally in the direction of the rows.

Another object is to distribute and space the cleats over the entire sole, to enhance safety where the surface engaged by the cleats is narrow, such as a narrow beam. For this purpose, the cleats are typically distributed over the arch region of the sole, in criss-cross relation, as well as over the sole, forward and rearward of the arch region.

An additional object is to provide the cleats in clusters, the cleats of each cluster having their long axes extending in parallel relation, and the long axes of cleats in adjacent clusters extending in different directions.

A further object is to locate certain cleats to be interrupted by edge extent of the sole; and typically large cleats are interrupted at the boot heel edge, and a still larger cleat profile is interrupted at the boot toe edge.

An additional object is to provide a protective peripheral band at the shoe sole edge to intersect certain cleats, and to shield cleat edges from catching on other surfaces.

These and other objects and advantages of the invention, as well as the details of an illustrative embodiment, will be more fully understood from the following specification and drawings, in which:

DRAWING DESCRIPTION

FIG. 1 plan view of a boot or shoe sole, with cleats distributed, as in clusters, over the shoe or boot sole area;

Figure 1:
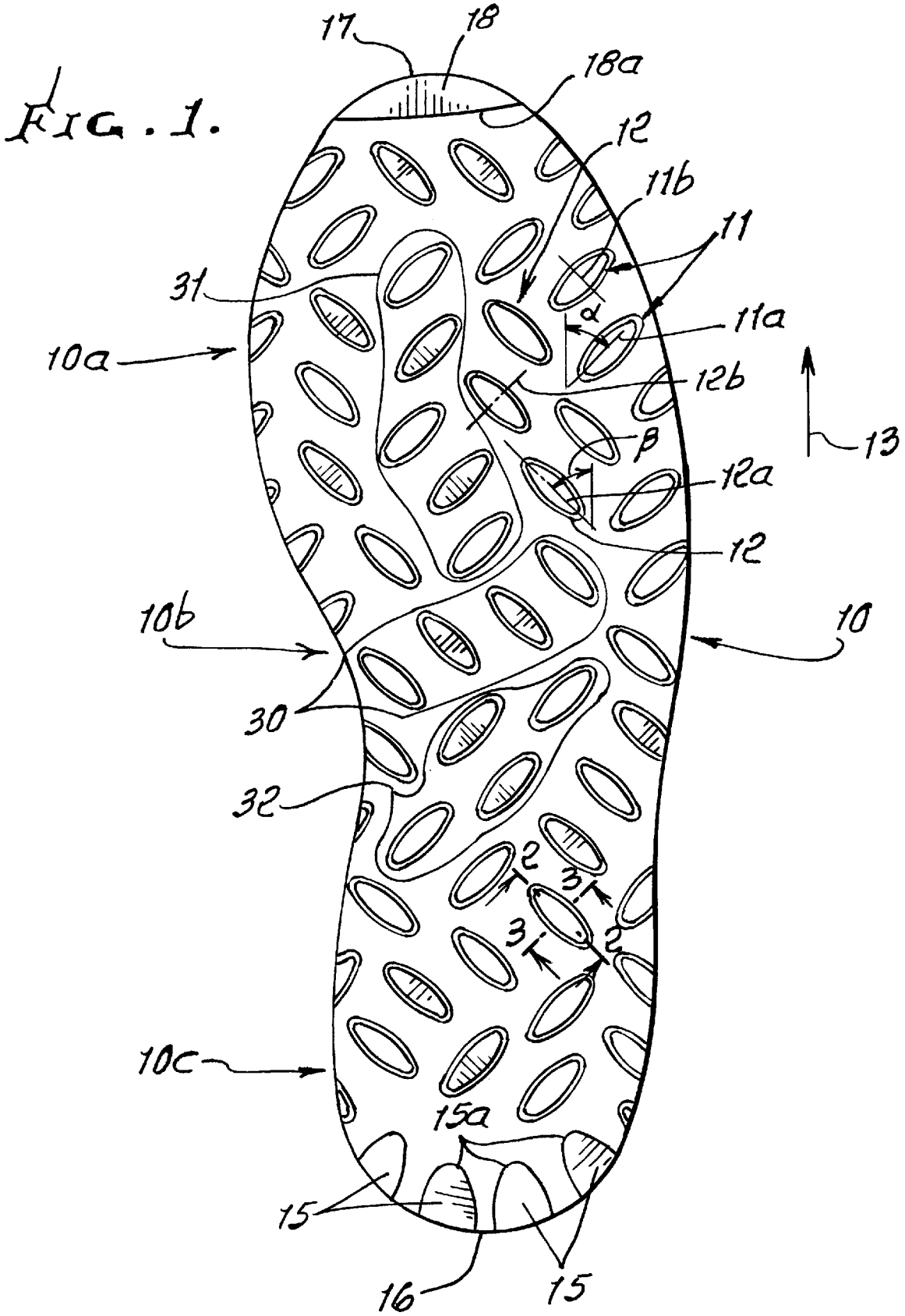
Figure 2:
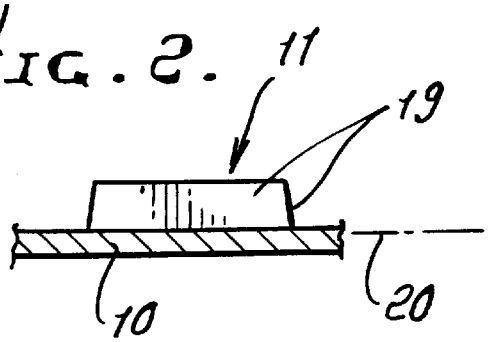
FIG. 2 is an enlarged view taken on lines 2—2 of FIG. 1.
Figure 3:
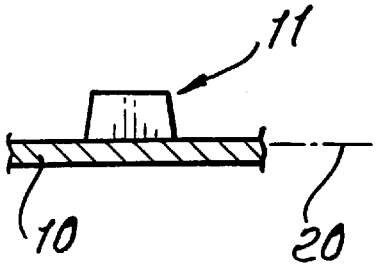
FIG. 3 is an enlarged view taken on lines 3—3 of FIG. 1.
Figure 5:
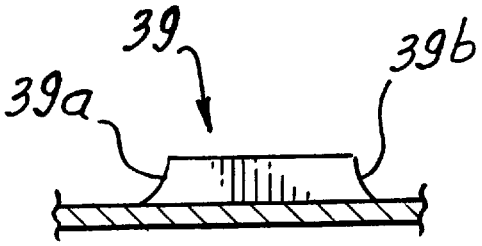
Figure 6:
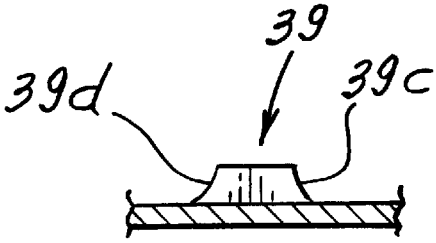
Figure 4:
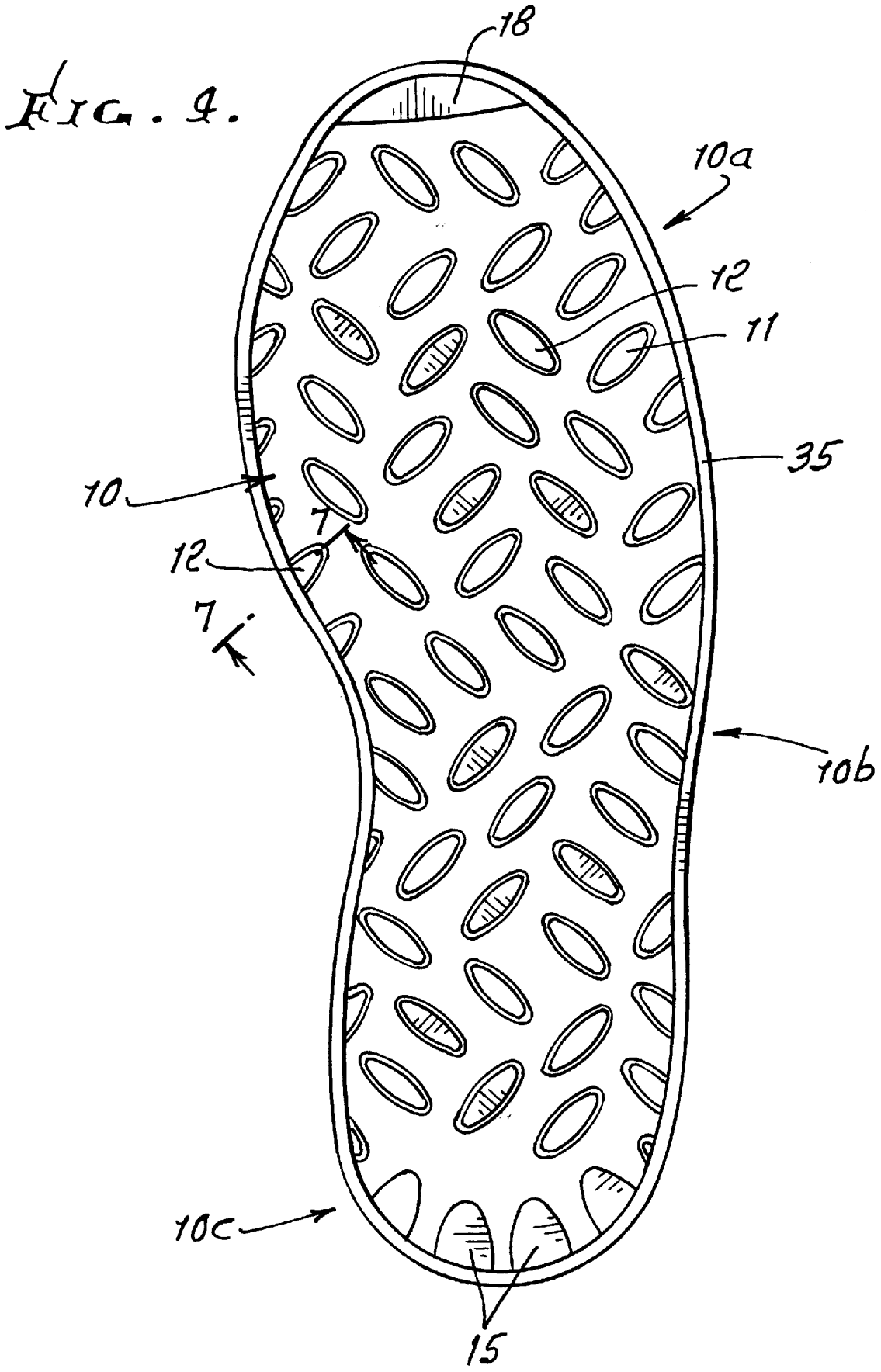

FIG. 4 as a view like FIG. 1, but showing a peripheral band intersecting certain cleats, and also bounding all cleats;

FIG. 5 is an enlarged view like FIG. 2, showing a modified cleat;

FIG. 6 is an enlarged view like FIG. 3, showing the modified cleat; and

Figure 7:
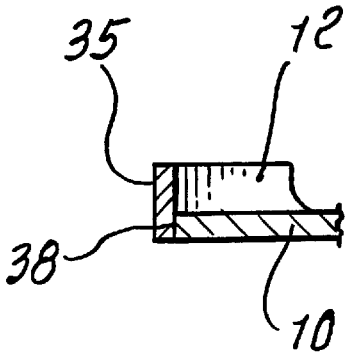

FIG. 7 is an enlarged section taken on lines 7—7 of FIG. 4.

DETAILED DESCRIPTION

In FIG. 1, a shoe or boot sole 10 has forward, intermediate and rear regions 10*a*, 10*b*, is and 10*c*. Such regions correspond to the ball region of the wearer's foot, the arch region of the foot, and the heel region of the foot, respectively.

Multiple cleats 11 and 12 are distributed over the sole, in spaced apart relation, the cleats being elongated (as for example generally elliptical) in plan view outline, as shown. Cleats 11 have major axes 11*a* that extend at angle $\alpha$ relative to the sole forward direction (see arrow 13); and cleats 12 have major axes 12*a* that extend at angle $\beta$ relative to the shoe sole forward direction. Typically, angles $\alpha$ are positive, and angles $\beta$ are negative. Also, typically, $\alpha=-\beta$. FIG. 2 is a side view of a cleat 11, taken normal to its major axis 11*a*; and FIG. 3 is a side view of the same cleat, taken normal to its minor axis 11*b*. Cleats 12 also have minor axes 12*b*. Major axis 11*a* length substantially exceeds the length of minor axis 11*b*; and the length of major axis 12*a* substantially exceeds the length of minor axis 12*b*.

As shown, most of the cleats have the same size, whereby the degree of traction development capability is about same, for balance, in all directions parallel to the sole, i.e. the plane of FIG. 1.

The sectioned cleats 15 in a group at the heel are substantially larger in area than the cleats 11 and 12; they too have curved profiles, but they intersect the curved rear edge 16 of the shoe sole, as shown, resulting in fore-shortening of the cleats 15. Also, a section of a single cleat 18 at the shoe toe is substantially larger in area than the cleats 11 and 12, and it intersects the curved forward edge 17 of the shoe sole, as shown. Shoe edge 16 extends generally parallel to the minor axes defined by cleats 15; and shoe edge 17 extends generally parallel to the major axis defined by cleat 18. Note also that the cleats at the left and right sides of the sole are intersected by those sides, whereby desired spacing of cleats is maintained. These geometrical features contribute further to the desired traction enhancement provided. Cleat edges 15*a* and 18*a* add further to such enhancement.

Note in FIGS. 2 and 3 that the side walls 19 of cleats 11, (and also of cleats 12) are substantially normal to the plane 20 of the shoe sole 10.

It will further be noted that certain cleats are in clusters or groups, as for example group 30 of four cleats 12; group 31 of five cleats 11; and group 32 of four cleats 11; etc.

Also, in a preferred embodiment, clusters or rows of cleats, as for example at 30 and 31, curve along their lengths, and successive cleats have their long axes extending in parallel relation and generally at angles to the direction of the row. Further, gaps are defined between successive generally elliptical cleats in the curved rows, such gaps being everywhere spaced away from all other nearest cleats.

Referring now to FIG. 4, it shows the same arrangement of cleats 11 and 12 as in FIG. 1. In addition, a border band 35 is attached to the periphery of the sole 10; it extends about the sole edge; and it may intersect cleats as indicated in FIG. 7. See cleat 12 intersected or interrupted at the sole edge location 38, by band 35. The band shields the tread, sidewardly, and may consist of elastomeric material. The cleats may consist of soft polymer, and may be bonded to the shoe sole.

FIGS. 5 and 6 show an elliptical form cleat 39 with outwardly concave walls 39*a*–39*d*, for shedding dirt.

Important characteristics of the described cleats are as follows:

1. Flat cleats 11 and 12, about ⅜ inch to about 1 inch in minor and major axis dimension, are separated by about ⅜ inch;

2. The cleats are distributed in the sole arch area as well as in heel and toe areas, of sole;
3. Where cleats are elliptical, major axes of ellipses are oriented in at least two directions, as at 11*a* and 14*a*, and symmetrically, so that traction doesn't favor any particular direction.
4. No three adjacent cleat edges are in a straight line.
5. Wedge soling (no proud heel).
6. Cleats consist of slip-resistant material, such as rubber or plastic;
7. Toe spring (toe curves upward from floor) to prevent tripping.

Other characteristics include:

8. Elliptical cleats are preferred; but more circular cleats are an alternative, as are polyhedron shaped cleated.
9. Cleats may consist of soft material (30–80 on IRHD scale).
10. Border band 35 around sole and cleats protectively shields the tread, as seen from side.
11. Cleats can be tapered, slightly, away from base (wider) to floor level (narrower), for mud-shedding.
12. Cleats can have curvature at base i.e. side of wall of cleat, for mud-shedding.
13. Rounded heel (curving upward from the floor) so that initial heel contact is not on a squared-off edge.
14. Cleat major axes can be in various directions as long as such directions are distributed symmetrically.
15. Cleats may have polyhedral outline shape.

Advantages of the cleat configuration include:

Slip Resistance

1. The traction is omnidirectional; no direction is favored. This is an advantage to workers who must move, and exert leg or foot force, in any direction
2. Locating tread over the entire sole helps wearers who work on narrow surfaces, such as 4-inch beams.
3. Small dimensions of individual cleats maximize total periphery of squared-edge length. The squared-off cleat edges as at 30 cut through water, mud and grease to make intimate contact with the floor.
4. Larger plan-form dimensions of the cleats at toe and trailing edge of heel improve wear while retaining squared cleats edges, and drainage channels between the cleats.
5. Curvature up from floor at trailing edge of heel provides more tread contact area at heel touchdown, to prevent slipping.
6. Slip-resistant material of the cleats, in addition to tread configuration, aids in traction.

Mud-Shedding

7. Mud-shedding is facilitated by tapered cleats, by curvature at the base of the cleat, and by the large distance (about ⅜ inch at the floor), separating the cleats.

Trip Prevention

8. Wedge sole (no proud heel) eliminates catching of heel on edges of beams, etc., which could cause the wearer to trip or lose balance.
9. A rim or band 35 around the cleats helps prevents catching of cleats on edges of beams, etc.
10. Having no three successive cleats in a straight line helps prevent large forces resulting from catching on edges.
11. Toe spring (curvature of toe away from floor) helps prevent trips.
12. Cleat long axes are preferably arrayed to extend at angles $\alpha$ between 30° and 60° relative to the sole length direction.

Important Results:

13. Preventing slips, trips, and loss of balance by those who work at height prevents falls that lead to serious injury or death.
14. Better traction and resulting greater confidence of workers increases working efficiency.

I claim:

1. The method of providing cleats on a boot sole to provide traction in all directions, the sole having a longitudinal length direction and a lateral width direction, that includes the steps:

a) providing the cleats to have profiles with short and long axes, the majority of the cleats having generally elliptical peripheral configuration, b) locating the cleats to extend on the sole in criss-cross diagonal row configuration, the cleats oriented to have their long axes extending at positive and negative angles relative to the longitudinal length direction of the sole, the long axes of the cleats in each row angled relative to the row length detection, c) said row configurations also characterized by multiple rows differently curving along their lengths, and by gaps defined between successive cleats in said curved rows, the gaps everywhere spaced away from all other nearest cleats.

2. The method of claim 1 including engaging said cleats with the support surface to provide traction in all directions.

3. The method of claim 1 wherein the sole has a foot arch subtending region and a foot ball subtending region, and said locating of the cleats includes distributing cleats at both of said regions in said criss-crossing diagonal row configuration.

4. The method of claim 1 wherein said cleat long axes are arrayed to extend at angles a between 30° and 60° relative to the sole length direction.

5. The method of claim 3 wherein the cleats are grouped in clusters of multiple cleats, and wherein the cleats of each cluster have their long axes extending in parallel relation, the long axes of cleats in adjacent clusters extending in different directions.

6. The method of claim 1 wherein multiple elliptical cleats are interrupted at the boot rearwardmost heel edge of the sole, and a larger cleat is interrupted at the boot sole toe edge.

7. The method of claim 1 wherein cleats nearest the lower edge of the sole have edges adjacent said sole edge.

8. In combination with a boot or shoe sole, a) spaced cleats extending in criss-cross diagonal row arrangement relation to the length direction of the sole, and defining multiple rows, b) the majority of said cleats having generally elliptical peripheral configuration, with short and long axes, c) successive cleats in each row having their said long axes extending in parallel relation and generally at angles to the direction of that row, said multiple rows curving along their lengths, d) there being gaps defined between successive generally elliptical cleats in said curved rows, the gaps being everywhere spaced away from all other nearest cleats.

9. The combination of claim 8 wherein the sole has a foot arch region, and a foot ball region, the cleats located at said regions.

10. The combination of claim 8 wherein said cleat long axes extend at angles a between 30° and 60° relative to said sole length direction.

11. The method of claim 1 wherein the cleats are grouped in clusters of multiple cleats, and wherein the cleats of each cluster have their long axes extending in parallel relation, the long axes of cleats in adjacent clusters extending in different directions.

12. The method of claim 1 including locating certain cleats to be interrupted by edge extent of the sole.

13. The method of claim 12 wherein multiple large cleats are interrupted at the boot or shoe heel edge, and a larger elliptical cleat is interrupted at the boot or shoe toe edge.

14. The method of claim 1 including providing a peripheral band at the shoe sole edge to bound all cleats.

15. The method of claim 1 wherein at least some cleats have side walls that are outwardly concave.

* * * * *